US007614625B2

(12) United States Patent
Dargue

(10) Patent No.: US 7,614,625 B2
(45) Date of Patent: Nov. 10, 2009

(54) POKER GAMES USING CARDS AND/OR DICE

(76) Inventor: Stan Dargue, 223 Lord Seaton Road, Toronto, Ontario (CA) M2P 1L2

( * ) Notice: Subject to any disclaimer, the term of this patent is extended or adjusted under 35 U.S.C. 154(b) by 262 days.

(21) Appl. No.: 11/469,841

(22) Filed: Sep. 1, 2006

(65) Prior Publication Data

US 2007/0052174 A1 Mar. 8, 2007

Related U.S. Application Data

(63) Continuation-in-part of application No. 11/428,368, filed on Jun. 30, 2006, now abandoned, and a continuation-in-part of application No. 11/419,367, filed on May 19, 2006, now abandoned, and a continuation-in-part of application No. 11/224,674, filed on Sep. 12, 2005, now Pat. No. 7,293,772, and a continuation-in-part of application No. 11/224,686, filed on Sep. 12, 2005, now Pat. No. 7,108,265, and a continuation-in-part of application No. 11/224,687, filed on Sep. 12, 2005, and a continuation-in-part of application No. 11/218,751, filed on Sep. 2, 2005, now Pat. No. 7,431,643.

(60) Provisional application No. 60/746,861, filed on May 9, 2006, provisional application No. 60/746,857, filed on May 9, 2006.

(51) Int. Cl.
*A63F 1/00* (2006.01)

(52) U.S. Cl. ..... 273/292; 273/274; 273/146

(58) Field of Classification Search ..... 273/292, 273/274, 309, 146; 463/12, 13
See application file for complete search history.

(56) References Cited

U.S. PATENT DOCUMENTS 5,423,551 A * 6/1995 Stavinsky ..... 273/306
6,062,563 A * 5/2000 de Keller ..... 273/274

OTHER PUBLICATIONS

"Knock Poker", Scarne's Encyclopedia of Games by John Scarne, Harper & Row Publishers, 1973, pp. 29-30.*
How To Play Casino Poker—Texas Hold-em, Victor Royer, http://www.vegas.com/vegascom/betbasc/holdem.*

* cited by examiner

*Primary Examiner*—Benjamin H Layno
(74) *Attorney, Agent, or Firm*—Muskin & Cusick LLC

(57) ABSTRACT

Card and/or dice games which can be played among several players. Each player tries to obtain a better poker hand than the other players. A player with the best poker hand can win the pot.

8 Claims, 3 Drawing Sheets

POKER GAMES USING CARDS AND/OR DICE

CROSS REFERENCE TO RELATED APPLICATIONS

This application is a continuation in part of application Ser. No. 11/218,751, filed on Sep. 2, 2005, now U.S. Pat. No. 7,431,643 which is incorporated by reference herein in its entirety. This application is also a continuation in part of application Ser. No. 11/224,674, filed on Sep. 12, 2005, now U.S. Pat. No. 7,293,772 which is incorporated by reference herein in its entirety. This application is also a continuation in part of application Ser. No. 11/224,686, filed on Sep. 12, 2005 now U.S. Pat. No. 7,108,265, which is incorporated by reference herein in its entirety. This application is also a continuation in part of application Ser. No. 11/224,687, filed on Sep. 12, 2005, which is incorporated by reference herein in its entirety. This application is also a continuation in part of application Ser. No. 11/419,367, filed May 19, 2006, now abandoned which claims benefit to provisional application No. 60/746,857, filed on May 9, 2006 both of which are incorporated by reference herein in their entirety. This application is also a continuation in part of application Ser. No. 11/428,368, filed on Jun. 30, 2006 now abandoned which claims benefit to provisional application No. 60/746,861, filed on May 9, 2006, both of which are incorporated by reference herein in their entirety.

BACKGROUND OF THE INVENTION

1. Field of the Invention

The present inventive concept relates to a wagering game, and more particularly to a game which allows players to wager against each other while forming poker hands.

2. Description of the Related Art

Texas Hold'em Poker has been exceedingly popular in recent times. However, the game has been played in its same form and some poker enthusiasts may appreciate newer variations, with more opportunities for a skilled player to excel.

SUMMARY OF THE INVENTION

It is an aspect of the present invention to provide an exciting wagering game.

The above aspects can be obtained by a method that includes (a) dealing a first hand to a first player, viewable only by the first player; (b) calling an actual rank of the current hand by the first player and placing a first bet; (c) allowing a second player to either fold or accept the first hand, wherein if the second player accepts the first hand, the second players views the first hand, and matches the first bet; (d) allowing the second player to exchange cards in the first hand to create a second hand; and (e) determining if the second hand has an improved rank over the first hand, and if not, the second player drops out of the hand, and if so, then the second player calls an actual rank of the second hand and places a second bet and play continues to a third player.

The above aspects can also be obtained by a method that performs (a) rolling, by first player, dice to form a first poker hand and place first wager; (b) participating, by each player in turn, by checking, folding, matching the first wager, or raising; and (c) rolling, by a second player, a single die which contains a termination indicia, and if termination indicia is determined to appear then the second player is eliminated.

The above aspects can also be obtained by a method that performs (a) dealing a plurality of hands, one to each player; and (b) allowing a current player a choice of one of the following options: 1) stay a current player's hand, 2) fold, or 3)continue play by checking or betting and play continues to a next player, (c) wherein if the current player chooses to stay the current player's hand, then an additional card(s) is dealt and all live players besides the current player can use the additional card(s) to form their poker hand, and a best poker hand out of all the live players wins the pot.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
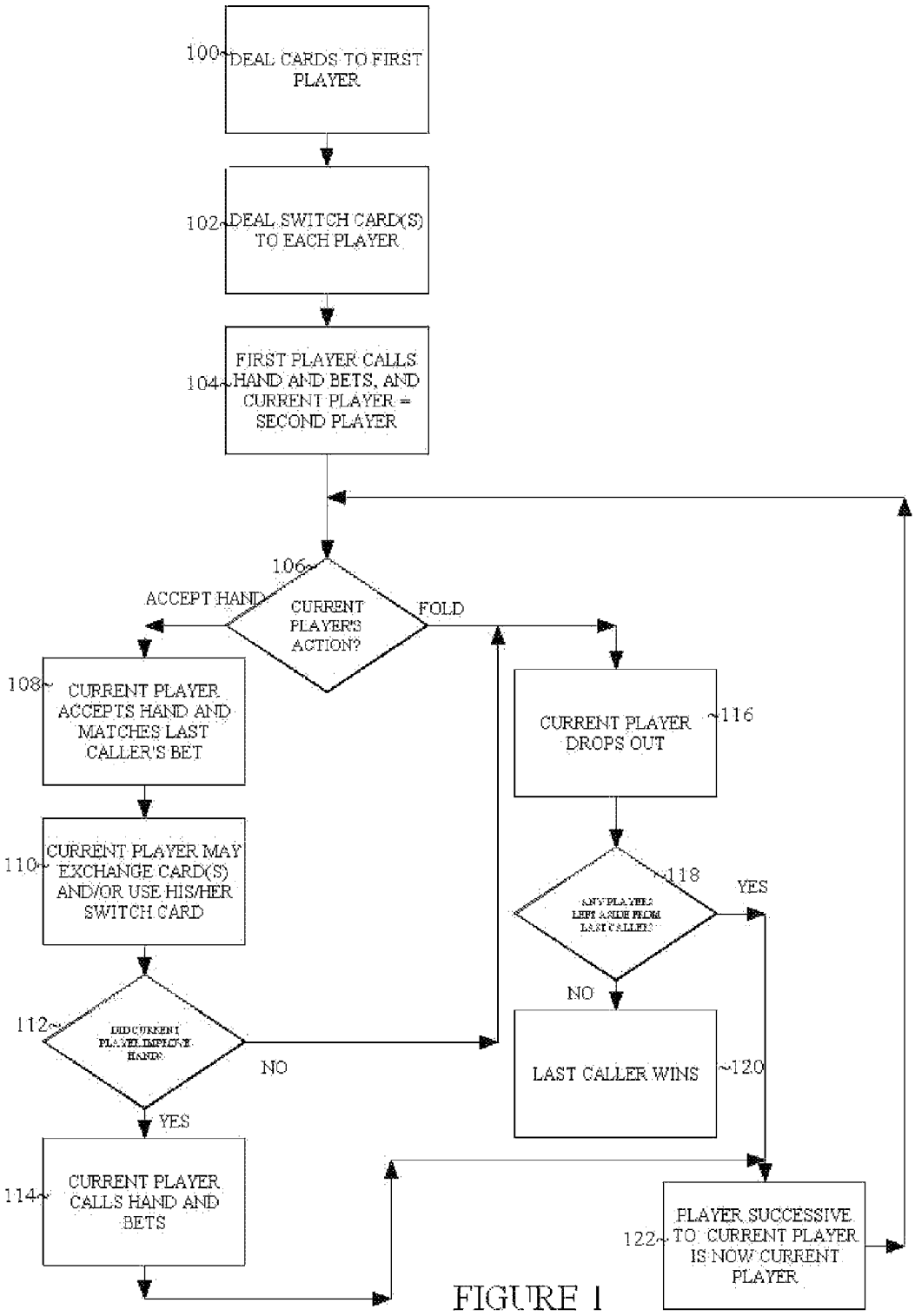
FIG. 1 is an exemplary flowchart illustrating a first embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer to player(s) a FIG. 1 is an exemplary flowchart illustrating a first embodiment of the present invention.

The method can start with operation 100, wherein five cards (although any number of cards can be used) are dealt to a first player face up (where they can be viewed by all players) from a deck of cards.

From operation 100, the method can proceed to operation 102, wherein one or two (or any number) of "switch cards" are dealt to each player. Note that the switch cards are typically dealt face down (although in an alternative embodiment they can be dealt face up), and each player can only view his or her respective switch cards.

From operation 102, the method can proceed to operation 104, wherein the first player calls a hand out and bets (chooses how much to bet). The first player may also exchange any selection and any number of cards in the hand from the deck. The second player (player sitting next to the first player in either clockwise or counterclockwise order) is now considered the "current player."

From operation 104, the method proceeds to operation 106, wherein the current player now determines his or her action. The current player may either accept the hand or fold.

If the determination in operation 106 results in the current player accepting the hand, then the method proceeds to operation 108, wherein the current player accepts the hand and much match the caller's bet. If the current player is the second player and the third player has not taken action yet, then the first player can be considered the caller.

From operation 108, the method can proceed to operation 110, wherein the current player can exchange any number/selection of the cards in the hand and can also exchange any selection of his or her switch cards for cards in the hand. All cards in the hand are visible to all players. If the player uses his or her switch card(s), then once used the cards now become visible (along with the rest of the hand).

From operation 110, the method can proceed to operation 112, which determines if the current player has improved the hand from the last called hand. If the current player did not improve the hand, then the method proceeds to operation 116, wherein the current player drops out. Note that in this game, there is no bluffing, as all cards of the hand are visible by all players.

If the current player did improve the hand, then the method proceeds to operation 114, wherein the current player calls the current hand and places a new bet. The method then proceeds to operation 122, wherein the player successive to the current player is not considered the "current player" and the method then returns to operation 106.

If the determination in operation 106 determines that the current player will fold, then the method proceeds to operation 116, wherein the current player drops out.

An example of the game will now be presented using four players (although any number of players can be used, e.g. 2-10). A hand of five cards is dealt to the first player (although any number of cards can be dealt). Two switch cards (although any number of switch card(s) can be used) are dealt to each player. The player's can view their own respective switch cards at any time, although players are not allowed to see other player's switch cards. The five cards dealt to the first player are Q/spades Q/hearts K/diamonds 2/clubs 5/clubs, and the first player's switch cards are J/spades Ten/hearts. The first player calls a "pair" since he has a pair of kings and bets $1. Alternatively, the first player can call "a pair of queens" as well.

Now play continues to the second player. The second player may either accept the hand or fold. The second player decides to accept the hand and bets $1. Thus, he then views the hand. The second player decides to exchange the Q/spades, Q/hearts, 2/clubs and 5/clubs (keeping only the K/diamonds) with the deck in hopes to improve the hand. Those four cards are discarded and four new cards are dealt to replace them: 5/hearts, K/clubs, 8/hearts, 9 spades. Player two has improved the previous hand (which was a pair of queens) to a pair of kings (since a pair of kings ranks higher than a pair of queens). Player two then calls a "pair of Kings" and bets $2. In this case the player specifies the rank (King) since the hand is still a pair just higher than the prior rank (queens). The player also may call out the former rank ("pair of queens").

Play now continues to the third player. The third player decides to fold. Thus, the third player does not need to put any money into the pot, and this player is now out of the game.

Play now continues to the fourth player. The fourth player decides to accept the hand and bets $2. Alternatively, the fourth player may be required to match every prior bet placed (before it was his turn) which would amount to $3 in this case (player one's bet and player two's bet). Player four now views the hand (5/hearts, K/clubs, 8/hearts, 9/spades, K/diamonds) and decides to replace the 5/hearts, 8/hearts, 9/spades. These three cards are discarded and the hand then receives a two/hearts, four/hearts, Jack/spades. This has not improved the hand. Player four has switch cards of: K/hearts, and 7/spades. Player four decides to use the K/hearts and he switches this card with the 9/spades. Thus, the hand now has the following cards: K/clubs, K/diamonds, K/hearts, 5/hearts, 8/hearts, which has a rank of three of a kind. The player then calls, "three of a kind" and bets $1.50.

Play now goes back to the first player, who decides to accept the hand and bets $1.50 (alternatively, player one could be required to match all bets after his last turn which would amount to $3.50). The first player views the cards in the hand: K/clubs, K/diamonds, K/hearts, 5/hearts, 8/hearts. The first player discards the 5/hearts and 8/hearts and replaces the, with 6/spades 9/clubs. This has not improved the hand. The first player's switch cards are 4/diamonds and 3/clubs. These also would not improve the hand. Thus, player one drops out.

Play continues to player two, who drops out. Thus, player four is the last player standing, thus player four wins the pot. The game is now over and a brand new game can begin.

A variation can also be played with dice as opposed to cards. Each die can have a card image on each side. Thus, rolling five dice can form a five card poker hand. A sixth die can have six sides as follows: 1) a termination card; 2) a wild card; 3) a switch card; 4) a second switch card; 5) a play card; and 6) a second play card. The operations of these faces on the sixth die will be explained below in further detail. Of course, this is just one example of a sixth die, and other dice can be used as well.

Figure 2:
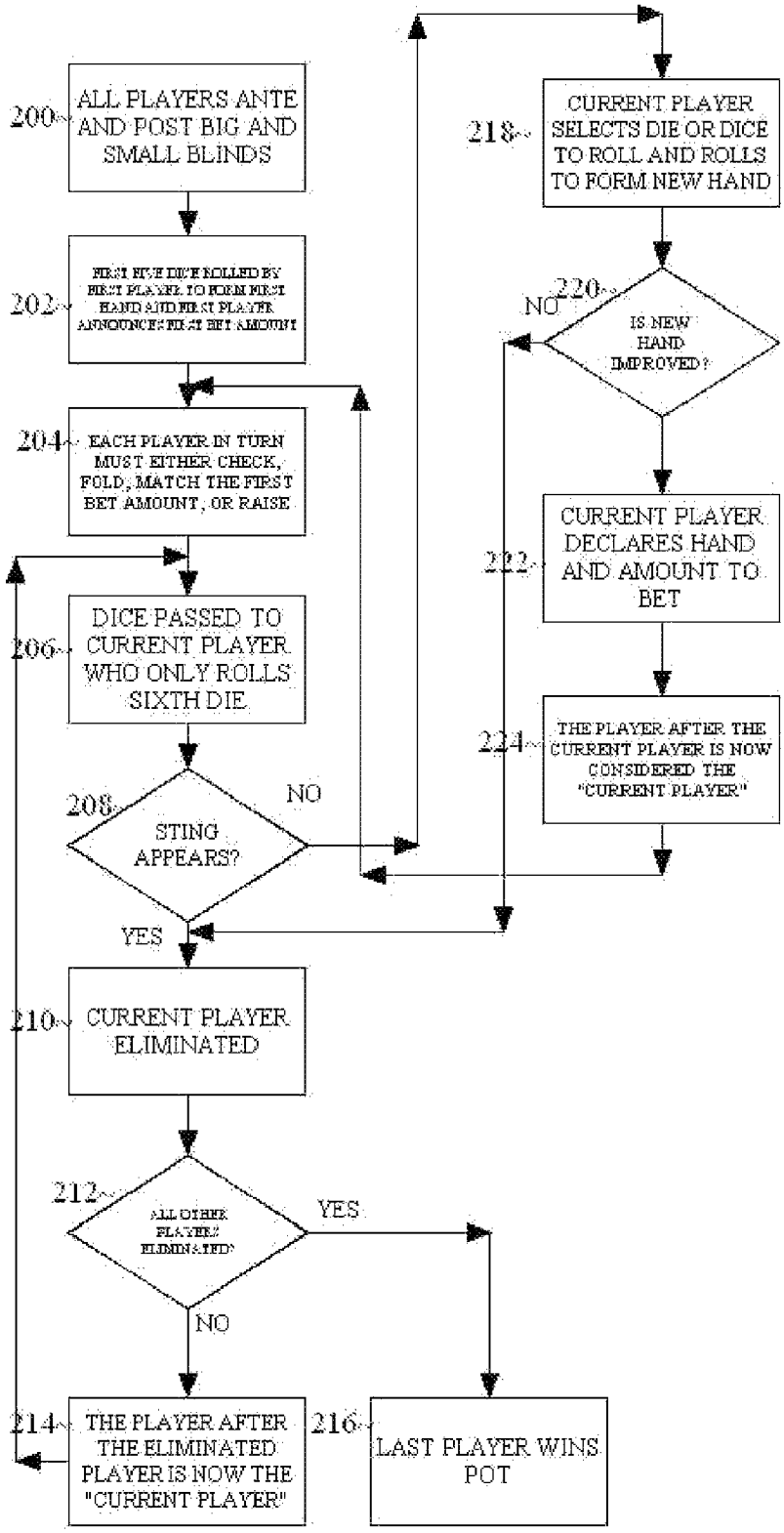
FIG. 2 is an exemplary flowchart illustrating a method of implementing a dice variation, according to an embodiment.

FIG. 2 is an exemplary flowchart illustrating a method of implementing a dice variation, according to an embodiment.

The method can start with operation 200, wherein all players ante and post big and small blind bets, as known in poker.

The method can then proceed to operation 202, wherein a first player rolls five dice to form a first hand and the first player also announces a first bet amount after viewing the first hand.

The method can then proceed to operation 204, wherein each player in turn must either check, fold, match the first bet amount, or raise. This is done as known in the art in a standard poker betting round.

From operation 204, the method can proceed to operation 206, wherein the dice are passed to a current player. If this is the first time this operation is being executed, then the current player is the player who follows the first player (e.g. sitting next to him in the play direction (e.g. clockwise or counter-clockwise)). Otherwise, the current player is defined in other operations. The current player then rolls only a sixth die.

From operation 206, the method can proceed to operation 208, which determines whether a sting symbol is rolled. If a sting symbol is rolled, then the method proceeds to operation 210, wherein the current player is eliminated (drops out of the game).

From operation 210, the method can proceed to operation 212, which determines whether all other players have been eliminated. If all other players have been eliminated, then the method proceeds to operation 216, wherein the last player remaining wins the pot and the game is over.

If in operation 212, it is determined that not all player have been eliminated, then the method proceeds to operation 214, wherein the player after the eliminated player is now considered to be the current player. The method then continues to operation 206.

If, in operation 208, a sting symbol is not rolled, then the method proceeds to operation 218, wherein the current player selects a die or dice to roll and rolls to form a new hand. The current player is attempting to improve the last rolled hand (poker hand value). The player can choose any die or dice out of the five dice (not including the sixth die) to roll.

From operation 218, the method proceeds to operation 220, which determines whether the hand is improved or not. If the new hand is not improved, then the method proceeds to operation 210.

If, in operation 220, the new hand is improved over the previously rolled hand, then the method proceeds to operation 222, wherein the current player declares his hand and amount to bet. A hand is improved if the new hand has a higher rank than the prior hand. In an embodiment, a "kicker" (the highest card in a hand not part of a pair/three of a kind/four of a kind/two pair) would not matter (e.g. 10*h*/10*c*/10*s*/4*h*/3*s* is the same rank as 10*h*/10*c*/10*s*/Ah/3*s*), wherein in another embodiment, the kicker would matter (in the prior example, the latter is hand, because the kicker (the ace) is higher than the four in the prior hand).

From operation 222, the method can proceed to operation 224, wherein the player after the current player is now considered the current player and play continues to operation 204.

An example of the game illustrated in FIG. 2 will now be presented using five players (although of course any number of players can be used). The poker dice used can, for example be as follows: die 1: 9*h*, 10*c*, Jd, Qs, Kh, Ac; die 2:9*c*, 10*d*, Js, Qh, Kc, Ad; die 3: 9*d*, 10*s*, Jh, Qc, Kd, As; die 4: 9*s*, 10*h*, Jc, Qd, Ks, Ah; and die 5: 9, 10, J, Q, K, A wherein all sides are "all suited."

All players put in an ante (any amount can be used, e.g. $1), and a first player can be selected (e.g. randomly) and the players next to the first player can post big and small blinds (e.g. $3 and $2).

Player one then rolls five poker dice and rolls: 9*h*, 10*d*, 10*c*, Qd, and A. The poker hand rank of this outcome is a pair of tens. Player one decides to bet $1. Player 2 bets $1. Player 3 bets $1. Player 4 bets $1 and raises $1 (for a total of $2). Player 5 now drops out (since he does not want to be $2). Player 1 puts in $1 (to match player 4's raise). Player 2 puts in $1. Player bets $1.

The dice are now passed to player two who only rolls a sixth die. The outcome of the sixth roll is a "switch card." This allows the player one extra roll of one of the die of the player's choice in an attempt to improve his hand. Thus, in this case, the player decides to re-roll the fourth die (Qd). The outcome of the roll is a Ks. Thus, the five dice now show: : 9*h*, 10*d*, 10*c*, Ks, and A. The hand rank is still a pair of 10's (the "kickers" or other cards not in the pair do not matter). Thus, player two has not improved the rank of the hand and thus player two is eliminated.

Play then proceeds to player three, who then rolls the sixth die. The player rolls a "play" which means the player just continues to play as normal. The five dice show: 9*h*, 10*d*, 10*c*, Qd, and A. Player three then decides to roll the first die (9*h*), the fourth die (the Qd) and the fifth die (A). The outcome of these rolls are: 9*h* (first die); 10*h* (fourth die), and K (fifth die). The dice now read: 9*h*; 10*d*; 10*c*; 10*h*; K. Player three has now made three of a kind (three 10's). This is improved over the prior hand (two 10's). The player declares three tens and bets $2. All of the other remaining players (player one, player four) bet $2.

Play now proceeds to player four. Player four rolls the sixth die. The outcome is a termination symbol (or "sting" card). This eliminates player four.

Only player one remains in the game. Thus, player one has won the pot and the game is over.

A further variation of a wagering game can be played using termination ("sting") cards. A standard deck of 52 cards can be used with four additional sting cards (cards that say "sting" on them). Two optional jokers can also be mixed into the deck.

Figure 3:
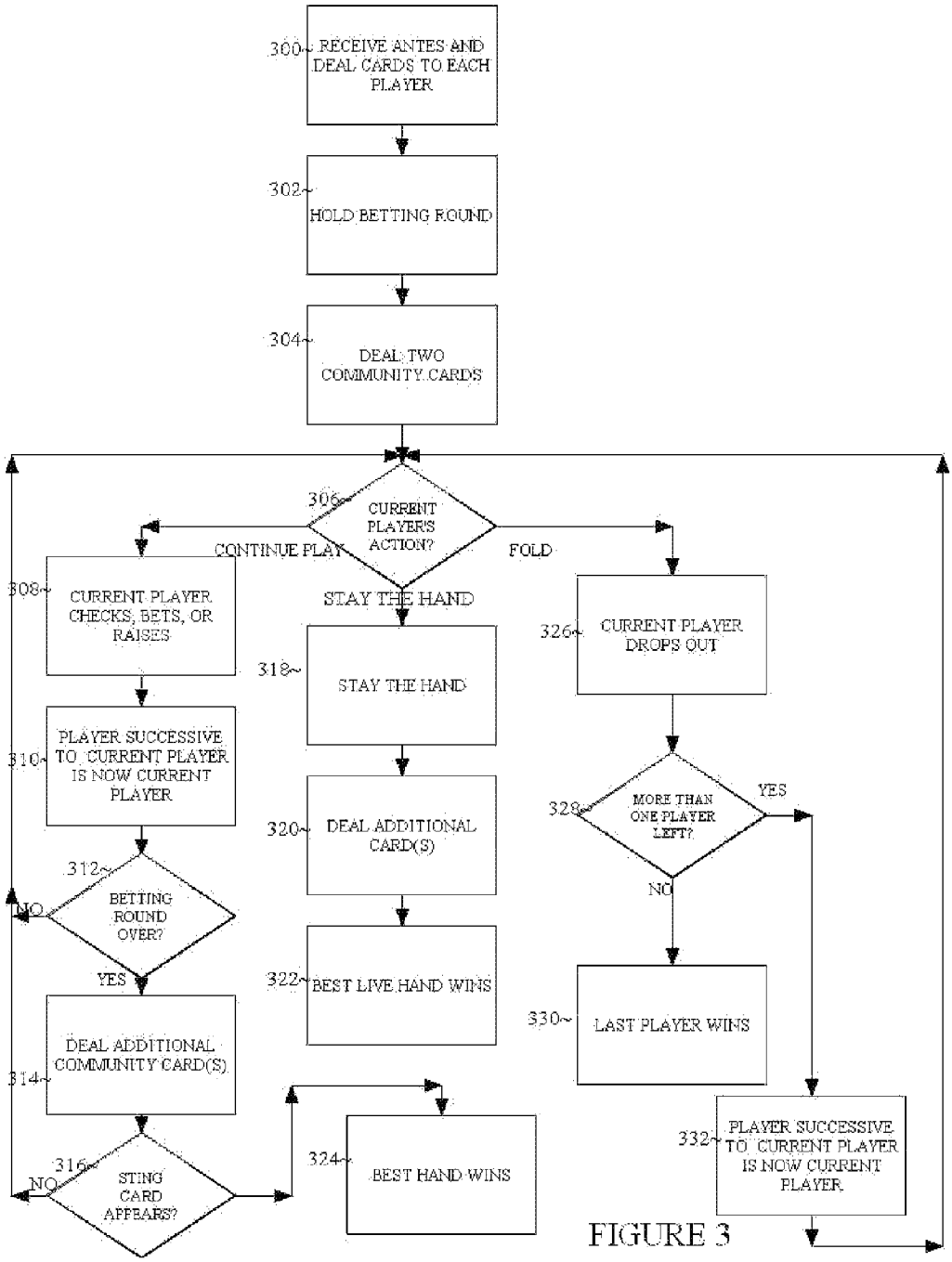
FIG. 3 is an exemplary flowchart illustrating an embodiment using termination cards.

FIG. 3 is an exemplary flowchart illustrating an embodiment using termination cards.

The method can start with operation 300, wherein each player antes and a hand is dealt to each player (e.g. five cards). If a sting card is dealt to a player it can serve as a wild card for that player. Alternatively, in a further variation, the sting card dealt to a player can immediately eliminate that player from the game (and he loses his ante).

Then the method can proceed to operation 302, wherein a betting round is held. This is done as known in the art.

From operation 302, the method can proceed to operation 304, which deals two (or any other number) of community cards. If a sting card appears during this operation, then it can be used as a wild card for all players.

From operation 304, the method proceeds to operation 306, wherein the current player takes an action (the current player can either: fold, continue player, or stay the hand).

If, in operation 306, the current player decides to fold, then the method proceeds to operation 326, wherein the current player drops out.

The method then proceeds to operation 328, which determines if there is more than one player left. If there is more than one player left, then the method proceeds to operation 332, wherein the player next to the current player is now the current player, and the method returns to operation 306.

If the determination in operation 328 determines that there is not more than one player left, then the method proceeds to operation 330, wherein the last player remaining wins the pot and the game is over.

In operation 306, if the current player's action is to stay the hand, then the method proceeds to operation 318, wherein the hand is stayed. This means that the current player's hand is fixed at its current rank and can no longer be improved.

From operation 318, the method then proceeds to operation 320, which deals additional cards (e.g. one or any other number).

From operation 320, the method proceeds to operation 322, which determines who has the best and then the best hand wins. The additional card(s) dealt in operation 320 can be used by all of the players except for the current player in order to improve their hand. Out of all of the players still remaining in the game (which does not include players that have dropped out), the player with the highest hand rank then wins the pot and the game is over. If a sting card is dealt in operation 320, then the player that stayed his/her hand wins and the other players are eliminated (in an alternative embodiment, if a sting card is dealt in operation 320, then it serves as a wild card for all of the players that did not stay their hand).

The current player would typically choose in operation 306 to stay his hand if he or she feels that their hand will be better than all of the other live players even though the other players will have the benefit of the additional card(s) dealt in operation 320 (wherein the current player that chose to stay the hand cannot use these cards).

From operation 306, the player can also choose to continue play, which proceeds to operation 308. The current player now checks, bets, or raises.

From operation 308, the method proceeds to operation 310, wherein the player successive to the current player is now considered the current player.

From operation 310, the method proceeds to operation 312, which determines if the betting round is over. If not all live players have checked, raised, or called (as known in poker)

after the last card was dealt, then the betting round is not over, and the method returns to operation 306.

If the determination in operation 312 determines that the betting round is over, then the method proceeds to operation 314, which deals additional community card(s), such as one. There is no limit to the number of times this operation can be reached (and hence the number of community cards dealt), and the players attempt to make the best hand out of their own cards and all of the community cards.

From operation 314, the method proceeds to operation 316, which determines whether the card(s) dealt in operation 314 contain a "sting" (or termination) card. If it does not, then the method proceeds to operation 306, which can start a new betting round with the current player.

If the determination in operation 306 determines that a sting card was dealt in operation 314, then the method can proceed to operation 324, which determines a best poker hand from all of the live players (players which did not drop out) and that player with the best poker hand wins the pot.

An example of the embodiment illustrated in FIG. 3 will now be presented with six players. A dealer "button," antes, and blind bets, as known in the poker art, are used in this embodiment.

Each player antes $1 into the pot (or any other amount). Three cards are dealt face down to each player, wherein each player is permitted to view only his/her own cards.

Player one is dealt: 7*d*/8*d*/3*s*; player two is dealt: Ks/Qh/3*c*; player three is dealt: 2*h*/2*c*/6*d*; player four is dealt: As/10*h*/5*c*; player five is dealt: 10*d*; 5*d*; As; player six is dealt: 4*d*/9*d*/7*h*. The betting round starts with player one: player one checks; player two bets $1; player three calls for $1; player four calls for $1 and raises $1; player five calls for $2; player six folds (and loses her ante); player one calls for $2; player two calls for $1 (since player two already bet $1); player three calls for $1 (since player three already bet $1). Thus, each live player has put $2 into the pot.

Now that the betting round is over, player one decides to continue player and checks. Player two checks. Player three raises $1; player four calls (puts in $1); player five calls (puts in $1); player one folds; and player two calls (puts in $1). Only players two, three, four, and five are still live.

Now that the betting round is over (all players have had a chance to check, call, or raise, a community card is dealt: 3*d*.

Player two now has to decide whether to play, stay the hand, or fold. Player two checks. Player three decides to stay the hand. An additional community card is dealt: 3*h*. Since player three has stayed the hand, player three is not allowed to benefit from the 3*h*. Thus, player three's final hand is 2*h*/2*c*/6*d*/3*d* or a pair of twos. Player two's final hand is: Ks/Qh/3*c*/3*d*/3*h*, or a three threes. Player four's final hand is: As/10*h*/5*c*/3*d*/3*h* (Ace high). Player five's final hand is: 10*d*/5*d*/As/3*d*/3*h* (Ace high).

Thus, player two has the higher hand and wins the pot.

Any embodiments described herein can be played with a standard deck of cards or any type of special deck (e.g. a Spanish deck, etc.) The game can also be played with a single deck or multiple decks (e.g. 1-8 decks or more). Poker hands can be ranked as well known in the art. For example see "Scarne's New Complete Guide to Gambling," by John Scarne, 1986, ISBN 0-671-21734-8, which is incorporated by reference herein in its entirety for all purposes. Further, the order of any of the operations described herein can be performed in any order and wagers can be placed/resolved in any order.

Any embodiments/features described herein can be combined with any other embodiments/features described herein (this includes any document incorporated by reference). Any embodiments herein can also be played in electronic form and programs and/or data for such can be stored on any type of computer readable storage medium (e.g. CD-ROM, DVD, disk, etc.)

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to resolve a poker game, the method comprising the operations of:

providing a physical deck of cards;

dealing only a first hand to a first player, viewable by all players;

calling an actual poker rank of the first hand by the first player and placing a first bet in a pot;

allowing a second player to either fold or accept the first hand, wherein if the second player accepts the first hand, the second players views the first hand, and matches the first bet;

allowing the second player to exchange cards in the first hand with an equal number of cards from the deck to create a second hand; and determining if the second hand has an improved poker rank over the first hand, and if not, the second player drops out of the hand, and if so, then the second player calls an actual poker rank of the second hand and places a second bet into the pot and play continues to a third player; continuing play until only one player remains in the game, and the remaining player winning the pot.

2. The method as recited in claim 1, wherein each player is also dealt switch card(s) which are optionally used by each player when each player exchanges cards.

3. The method to resolve a poker game as recited in claim 1, the method comprising:

allowing the third player to either fold or accept the second hand, wherein if the third player accepts the second hand, the third player views the third hand and matches the second bet, and then exchanges cards in the third hand with an equal number of cards from the deck to try to improve the second hand.

4. The method to resolve a poker game as recited in claim 1, the method comprising:

allowing the third player to either fold or accept the second hand, wherein if the third player accepts the second hand, the third player views the third hand and matches the first bet and the second bet, and then exchanges cards in the third hand with an equal number of cards in the deck to try to improve the second hand.

5. A method to resolve a poker game using dice, the method comprising the operations of:

providing a plurality of physical dice, each die comprising a plurality of sides and each die comprising a card value on each side;

rolling, by first player, dice to form only a first poker hand and placing a first wager in a pot;

viewing the first poker hand by all the players;

participating, by each player in turn, by checking, folding, matching the first wager in the pot, or raising in the pot; and rolling, by a second player, a single die which comprises a termination indicia on one side of the single die, and if the termination indicia is determined to appear then the second player is eliminated, if the single die is determined not to roll the termination indicia, then the second player can reroll any selected combination of the dice and exchange card values in the first poker hand with an equal number of card values appearing on the rerolled dice to form a second poker hand, continuing play to the next player until only one player remains in the game and the remaining player winning the pot.

6. The method as recited in claim 5, wherein if the second poker hand is determined not to be a higher rank than the first poker hand, then the second player is eliminated, otherwise the second player places a second bet.

7. A method to play a poker game among a plurality of players in order to award a pot, the method comprising the operations of:

providing a physical deck of playing cards;

receiving an ante wager from each player in a pot;

dealing a plurality of playing cards to form a plurality of poker hands, one hand to each player; and allowing a current player a choice of one of the following options: 1) stay a current player's hand, 2) fold, or 3) continue play by checking or betting and play continues to a next player, wherein if the current player chooses to stay the current player's hand, then an additional card(s) is dealt and all live players except for the current player can use the additional card(s) to add to their hand to form their poker hand, and a best poker hand out of all the live players wins the pot.

8. The method as recited in claim 7, wherein if the current player chooses to continue play, then performing:

completing a betting round;

dealing community card(s) available for use by all players; and determining whether the additional community card(s) includes a termination card, and if so, then determining which live player has a best poker hand to become a winning player, and awarding the pot to the winning player.

* * * * *